US011885216B2

(12) United States Patent
Lagrange et al.

(10) Patent No.: US 11,885,216 B2
(45) Date of Patent: Jan. 30, 2024

(54) PERFORATING AND TRACER INJECTION SYSTEM FOR OILFIELD APPLICATIONS

(71) Applicant: CORE LABORATORIES LP, Houston, TX (US)

(72) Inventors: Timothy E. Lagrange, Lacombe (CA); David Chastain, Brookshire, TX (US); Shaun Geerts, Joshua, TX (US); Joe McClanahan, Weatherford, TX (US); Gary Bablitz, Calgary (CA)

(73) Assignee: CORE LABORATORIES LP, Houston, TX (US)

( * ) Notice: Subject to any disclaimer, the term of this patent is extended or adjusted under 35 U.S.C. 154(b) by 97 days.

(21) Appl. No.: 17/769,695

(22) PCT Filed: Oct. 19, 2020

(86) PCT No.: PCT/US2020/056322
§ 371 (c)(1),
(2) Date: Apr. 15, 2022

(87) PCT Pub. No.: WO2021/077082
PCT Pub. Date: Apr. 22, 2021

(65) Prior Publication Data

US 2022/0381140 A1 Dec. 1, 2022

Related U.S. Application Data

(60) Provisional application No. 62/923,115, filed on Oct. 18, 2019.

(51) Int. Cl.
*E21B 47/11* (2012.01)
*E21B 43/117* (2006.01)

(52) U.S. Cl.
CPC ..... *E21B 47/11* (2020.05); *E21B 43/117* (2013.01)

(58) Field of Classification Search
CPC ..... E21B 47/11; E21B 43/117
See application file for complete search history.

(56) References Cited

U.S. PATENT DOCUMENTS 3,305,032 A 2/1967 Schuster et al.
3,507,340 A * 4/1970 Voetter ..... E21B 43/025 166/100

(Continued)

FOREIGN PATENT DOCUMENTS

WO 0165053 A1 9/2001
WO 2008024448 A1 2/2008
WO 2017155412 A1 9/2017

OTHER PUBLICATIONS

PCT/US2020/056322, ISR dated Jan. 29, 2021.

*Primary Examiner* — Steven A MacDonald
(74) *Attorney, Agent, or Firm* — Crowe & Dunlevy, P.C.

(57) ABSTRACT

A method for completing a subterranean formation includes conveying a perforator assembly into a borehole drilled in the subterranean formation. The perforator assembly includes at least one shaped charge and at least one tracer package that includes at least one fluid production tracer material and a tracer injector. The method further includes forming at least one tunnel in a production structure by detonating one or more shaped charges and injecting the at least one fluid production tracer material into the formation using the tracer injector after the detonation of the at least one shaped charge. The at least one production tracer material physically associates with at least one resident fluid in the subterranean formation.

12 Claims, 6 Drawing Sheets

(56) References Cited

U.S. PATENT DOCUMENTS

| | | | | |
|---|---|---|---|---|
| 5,366,013 | A * | 11/1994 | Edwards | E21B 17/07 166/55.1 |
| 5,413,179 | A | 5/1995 | Scott, III | |
| 8,833,154 | B2 * | 9/2014 | Skillingstad | E21B 47/09 166/250.12 |
| 10,337,300 | B2 * | 7/2019 | Davidson | E21B 43/119 |
| 2002/0079098 | A1 | 6/2002 | Clark et al. | |
| 2009/0087912 | A1 * | 4/2009 | Ramos | E21B 47/11 436/27 |
| 2009/0272529 | A1 * | 11/2009 | Crawford | E21B 47/10 166/250.15 |
| 2010/0147587 | A1 * | 6/2010 | Henderson | E21B 43/263 175/2 |
| 2013/0017610 | A1 * | 1/2013 | Roberts | C09K 11/06 436/27 |
| 2013/0075090 | A1 * | 3/2013 | Woiceshyn | E21B 43/08 166/227 |
| 2013/0091943 | A1 * | 4/2013 | Skillingstad | E21B 47/11 73/152.54 |
| 2016/0084072 | A1 * | 3/2016 | Flores | E21B 47/06 166/250.01 |
| 2017/0037712 | A1 * | 2/2017 | Davidson | F42D 1/00 |
| 2019/0040722 | A1 * | 2/2019 | Yang | E21B 43/11 |
| 2021/0047903 | A1 * | 2/2021 | Albert | E21B 43/119 |
| 2022/0397376 | A1 * | 12/2022 | Chen | F42B 1/032 |
| 2023/0115055 | A1 * | 4/2023 | Eitschberger | E21B 43/119 175/4.57 |

* cited by examiner

PERFORATING AND TRACER INJECTION SYSTEM FOR OILFIELD APPLICATIONS

BACKGROUND OF THE DISCLOSURE

1. Field of Disclosure

The present disclosure relates to an apparatus and method for completing a well.

2. Description of the Related Art

Hydrocarbon producing wells typically include a casing string positioned within a wellbore that intersects a subterranean oil or gas deposit. The casing string increases the integrity of the wellbore and provides a path for producing fluids to the surface. Conventionally, the casing is cemented to the wellbore face and is subsequently perforated by detonating shaped explosive charges. When detonated, the shaped charges generate a jet that penetrates through the casing and cement and forms a tunnel of a short distance into the adjacent formation. Thereafter, reservoir fluids may be produced via the tunnel.

Often, multiple zones of a formation are perforated. Each zones produces fluids via a wellbore that intersects those zones. The fluids comingle from the zones as they flow to the surface. Thus, it may be difficult to determine which zone is producing a useful fluid, such as a hydrocarbon, an undesirable fluid, such as water, or is not producing at all.

The present disclosure address the need to better characterize the production characteristics of a subsurface formation as well as other needs of the prior art.

SUMMARY OF THE DISCLOSURE

In aspects, the present disclosure provides a method for completing a subterranean formation having a borehole and a production structure. The method may include conveying a perforator assembly into a borehole drilled in the subterranean formation. The perforator assembly may include at least one shaped charge and at least one tracer package. The tracer package may include at least one fluid production tracer material and a tracer injector. The method further includes forming at least one tunnel in the production structure by detonating one or more shaped charges and injecting the at least one fluid production tracer material into the formation using the tracer injector after the detonation of the at least one shaped charge. The at least one production tracer material is configured to physically associate with at least one resident fluid in the subterranean formation.

In aspects, the present disclosure provides an apparatus for marking a selected location of a subterranean formation. The apparatus may include a perforator assembly having at least one production tracer material and a tracer injector configured to inject the at least one production tracer material into the subterranean formation.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
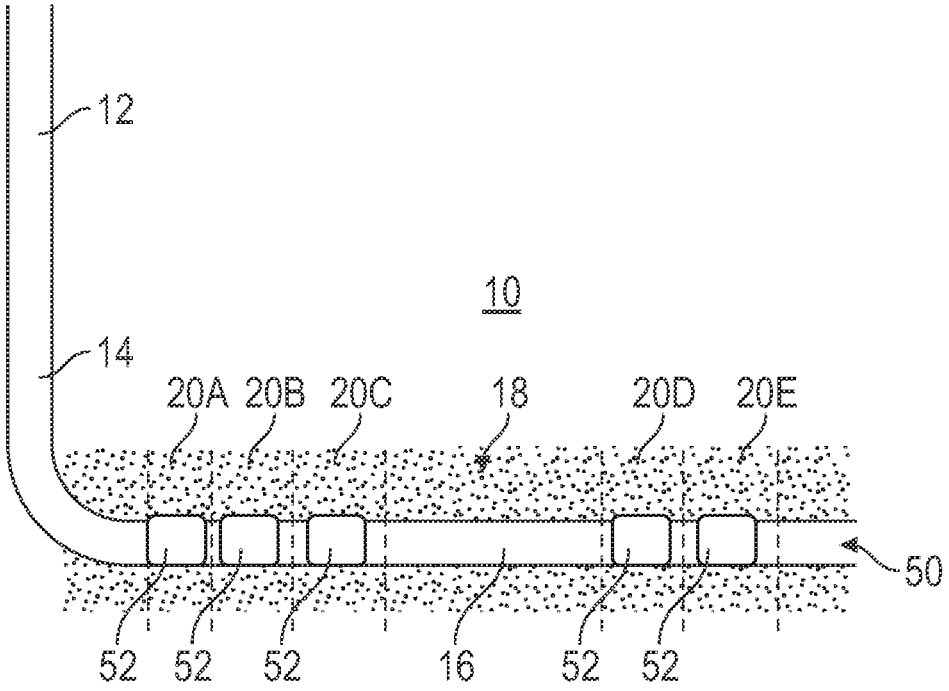
FIG. 1 is a schematic sectional view of a completion tool according to an embodiment of the present disclosure that is positioned in a horizontal section of a well.

Referring to FIG. 1, there is shown a subsurface formation 10 in which a borehole 12 has been formed. The borehole 12 may include a vertical section 14 and a deviated section 16. The illustrated deviated section 16 is shown as horizontal but other deviations from vertical may also be present. Also, the borehole 12 may have a more complex geometry, e.g., two or more vertical sections, two or more deviated sections, etc. Conventionally, the borehole 12 may have a wellbore tubular such as casing (not shown) surrounded by a cement sheath (not shown). The borehole 12 may intersect a reservoir 18 that has multiple production zones 20A-E. While five zones are shown, it should be understood that fewer or greater number of production zones may be present.

In aspects, the present disclosure provides systems and related methods that enable each zone 20A-E to be uniquely marked such that an analysis of the fluids produced from the borehole 12 can provide a production profile, i.e., what zones are producing a particular fluid, even though the produced fluids may be a mixture of fluids from multiple production zones. Generally, a perforating tool 50 having a plurality of enhanced perforating assemblies 52 may be used to individually perforate and mark with a unique tracer each of the zones 20A-E. These unique tracers may be referred to as fluid production tracers because they are configured to interact with one or more resident fluids in the formation. These resident fluids may be a naturally occurring gas and/or liquid as well as a fluid injected from the surface. This interaction results in a physical association of tracer to one or more selected resident fluids such that the tracer flows with the selected fluid(s) to the surface. Sampling of the resident fluids at the surface allows characterization of production of these resident fluids at the surface. The perforator assemblies 52 are considered "enhanced" because they include one more tracer packages as described in greater detail below. For brevity only, certain embodiments refer to chemical tracers. However, the present teachings can be utilized with any tracer type, e.g., radioactive, DNA, particulate.

Figure 2:
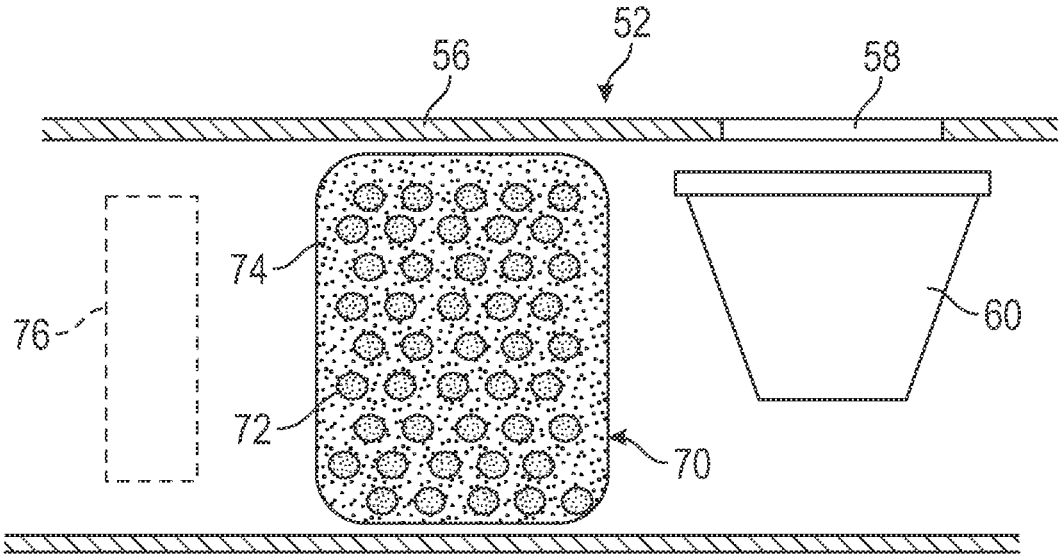
FIG. 2 is an embodiment of a tracer package according to one embodiment of the present disclosure wherein a gas generator and a tracer are combined in a capsule.

Referring to FIG. 2, there is schematically illustrated a perforator assembly 52 in accordance with one embodiment of the present disclosure. The perforator assembly 52 may include one or more tracer capsules 70 that are disposed in an enclosure 56 and adjacent to one or more shaped charges 60. The tracer capsules 70 may be formulated and configured to release and inject one or more fluid production tracers into an adjacent formation.

In one embodiment, the tracer capsule 70 may include a tracer material 72 dispersed in a tracer injector configured as a gas generator 74, i.e., a gas generating tracer injector. When initiated, the gas generator 74 generates a high pressure gas while simultaneously releasing the embedded tracer material 72. By "initiate" or "initiated," it is meant applying a stimulus such as kinetic, thermal, and/or electrical energy that causes a reactions such as burning, an ignition, combusting, a detonation, an/or other release of energy. The high pressure gas propels the fluid production tracer material 72 through an opening 58 in the enclosure 56 and into the adjacent formation (not shown). The opening 58 may be pre-existing or created by the shaped charge 60. The tracer capsule 70 may have an external membrane, skin, or shell (not shown) in which the fluid production tracer material 72 is contained. Alternatively, the fluid production tracer material 72 may be a compact solid body in which the fluid production tracer material is suspended or bound in a suitable binder.

The fluid production tracer material 72 may be selected and configured to interact and physically associated with one or more selected resident fluids, such as water or hydrocarbons. The interaction binds, couples, attaches, fixes, or otherwise physically associates the fluid production tracer material 72 with at least a portion of the selected resident fluid(s). Thus, the fluid production tracer material 72 flows with the associated resident fluid to the surface. The interaction is sufficient such that analysis of the resident fluid(s) produced at the surface can assist in characterizing fluid production from one or more subsurface production zones. The fluid production tracer 72 may be in the form of a powder, solid, liquid, gas, gel, or mixtures thereof. The fluid production tracer material 72 may include a chemical tracer such as a water soluble tracer to mark water, an oil soluble tracer to mark liquid hydrocarbons, or a gas tracer to mark gases such as gaseous hydrocarbons. Suitable tracers include halogenated organic acid, organic salts, inorganic salts, halogenated aromatic hydrocarbons, naphthalene sulfonates, radioactive isotopes, DNA, and other similar markers. Any of the above tracers may be adsorbed onto a solid media, such as polymeric resin or charcoal.

The gas generator 74 may include a gas generating material such as a propellant. Suitable propellants include, but are not limited to, a solid "oxidizer" component and a compound such as any nitramine type compound such as cyclotetramethylenetetranitramine (HMX), ammonium nitrate, diammonium bitetrazole, ammonium picrate, 1,2-dicyanotetranitroethane, hexanenitroethane, flourotrinitromethane and dihydrazinium 3,6-bis(5-tetrazoyl) dihydrotetrazine. Gas generating materials may also include thermites, PETN, HNS, RDX, black powder, BKNO3, TEFLON, perchlorates, aluminum, etc. Suitable gas generating materials may include components such as a solid oxidizer such as ammonium perchlorate or ammonium nitrate; a synthetic rubber such as HTPB, PBAN, polymers (e.g., polyurethane, polyglycidyl nitrate, etc.); and fuels such as nitroglycerin, and a metal such as aluminum.

The tracer capsule 70 may be formed as a solid compacted body wherein the gas generator 74 acts as a binder or matrix for the fluid production tracer material 72. The fluid production tracer material 72 may make up 10%, 20%, 30%, 40%, 50% or more than 50% of the total volume of the tracer capsule 70. The tracer capsule 70 may consist only of the gas generator 74 and the fluid production tracer material 72. Alternatively, the tracer capsule 70 may include one or more additional materials; e.g., an inert filler material such as sand. The compacted body may be formed by known mechanical processes such as mechanical compression.

The gas generator 74 may be initiated using the detonation of the shaped charge 60. For example, thermal energy and shock waves released by the detonation of the shaped charge 60 may fragment or disintegrate the capsule 70 and initiate the gas generator 74. The released thermal energy and shock waves may be referred to as activation energy. In other arrangement, a separate igniter 76 may be used to initiate the gas generator 74.

Figure 3:
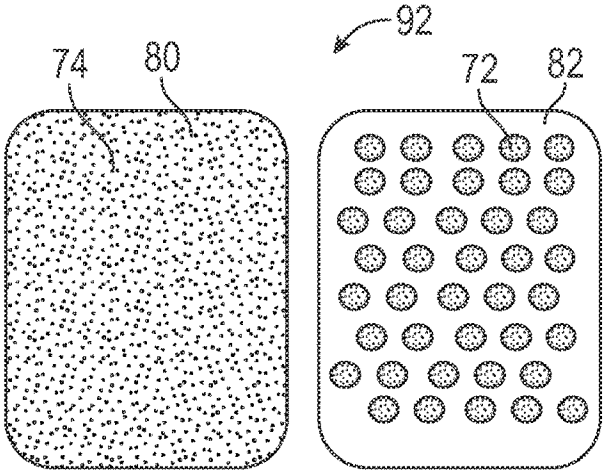
FIG. 3 is an embodiment of a tracer package according to one embodiment of the present disclosure wherein a gas generator and a tracer are positioned in separate capsules.

Referring to FIG. 3, there is schematically illustrated another tracer package 92 in accordance with one embodiment of the present disclosure. The tracer package 92 may include a gas generator pellet 80 formed partially or completely of the gas generator material 74 and a tracer pellet 82 formed partially or completely of one or more fluid production tracer materials 72. The gas generator pellet 80 may be formulated and configured to disintegrate the tracer pellet 82 and propel the released tracer(s) into an adjacent formation. The pellets 80, 82 may be formed as compact bodies or shells as described previously. Further, the gas generator 80 may be initiated using a shaped charge 60 or a separate igniter 76 as described in connection with FIG. 2. Where a separate igniter 76 (FIG. 2) is used, the detonation of the gas generator 80 can be independent of the detonation of the shaped charge 60. That is, the gas generator 80 may be initiated prior to, during, or after the detonation of the shaped charge 60 (FIG. 2).

Figure 4:
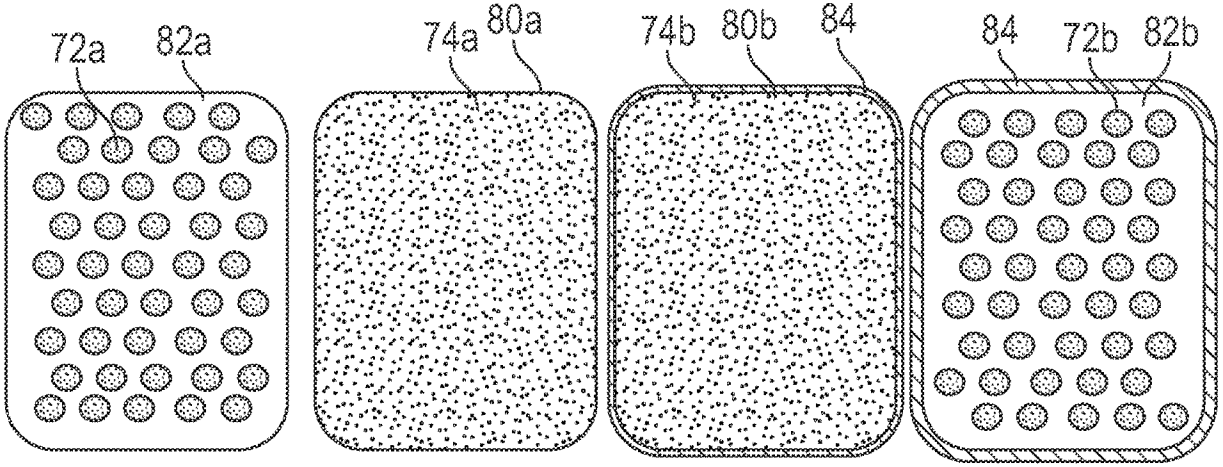
FIG. 4 is an embodiment of a tracer package according to one embodiment of the present disclosure that uses multiple gas generator/tracer capsules.

Referring to FIG. 4, there is schematically illustrated still another tracer package 102 in accordance with an embodiment of the present disclosure. The tracer package 102 may include gas generator pellets 80*a,b* formed partially or completely of the gas generator material 74*a,b* and tracer pellets 82*a,b* formed partially or completely of one or more chemical tracers 72*a,b*. As before, the gas generator pellets 80*a,b* may be formulated and configured to disintegrate the tracer pellets 82*a,b* and propel the released tracer(s) into an adjacent formation. The pellets 80*a,b*, 82*a,b* may be formed as compact bodies or shells as described previously. In this embodiment, the gas generating material and the fluid production tracer material are completely separated from one another. Further, the gas generator 80*a,b* may be initiated using a shaped charge 60 or a separate igniter 76 as described in connection with FIG. 2.

Referring still to FIG. 4, there is a variant of a tracer package in which the fluid production tracer material and/or the gas generator are sealed or contained in a shell 84 or other similar enclosure; e.g., skin, bladder, canister, container, etc. The shell 84 may be configured to disintegrate, dissolve, crack, fracture, combust, or otherwise degrade sufficiently in order to expose the gas generator 74 to activation energy and to release the fluid production tracer material 72. Additionally, the shell 84 for the fluid production tracer material may be configured to release the fluid production tracer material while the gas generator 74 is combusting or after a majority of the gas generator 74 has combusted.

In the FIG. 4 embodiment, the gas generator pellets 80*a,b* may have the same formulation or different formulations. That is, burn rate, amount of pressurized gas released, the pressure of the released gas, and other operating characteristics may be the same or different between the gas generator pellets 80*a,b*. Likewise, the tracer pellets 82*a,b* may have the same formulation or different formulations. That is, the concentration, type, and other chemical or physical characteristics may be the same or different between the tracer pellets 82*a,b*. Thus, it should be appreciated that by using pellets of different formulation, the amount and type of fluid production tracer material may be individualized, as well as how the fluid production tracer material is injected into an adjacent formation.

Figure 5A:
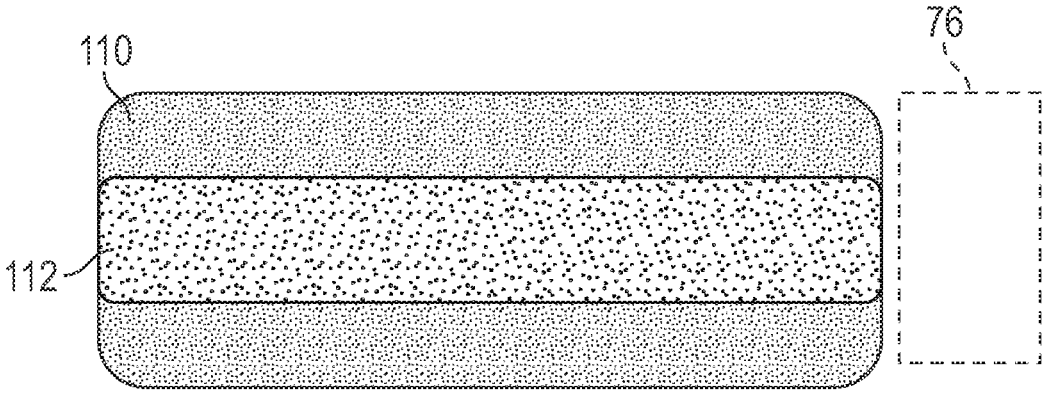
FIGS. 5A-B are another embodiments of tracer packages according to embodiments of the present disclosure wherein generator/tracer capsules are elongated bodies.
Figure 5B:
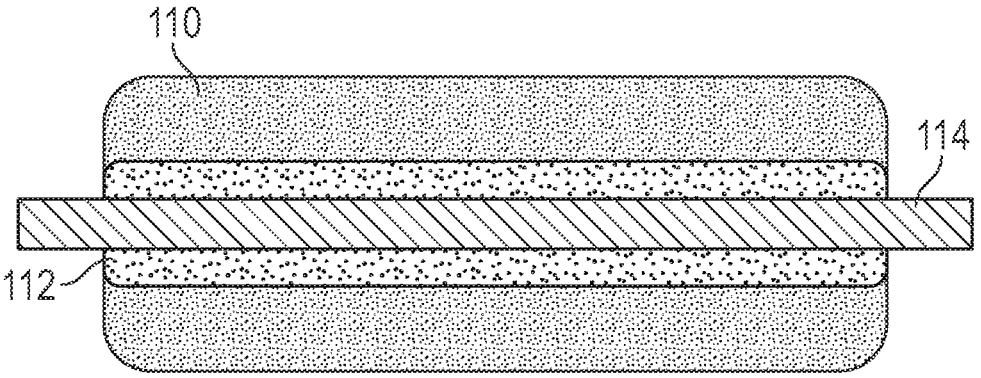

It should be understood that perforating assemblies according to the present disclosure are not limited to only the geometries or configurations described above. For example, referring to FIG. 5A, the tracer is formed as a sleeve 110 that surrounds a rod of gas generator 112. The gas generator 112 may be initiated using the detonation of the shaped charge 60 (FIG. 2). As shown in FIG. 5A, a separate igniter 76 may be used to initiate the gas generator 112. As shown in FIG. 5B, a detonator cord 114 that is surrounded by the gas generator 112 and the tracer sleeve 110 may be used to initiate the gas generator 112.

Figure 6A:
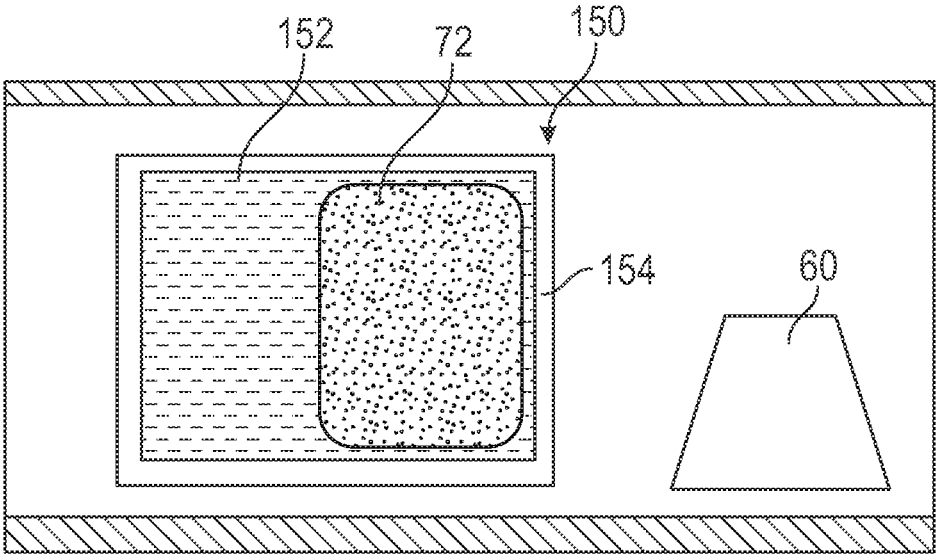
FIGS. 6A-B illustrate further embodiments of tracer packages according to the present disclosure.

Referring to FIG. 6A, there is schematically illustrated another tracer package 150 in accordance with one embodiment of the present disclosure. The tracer package 150 may include a body of fluid production tracer material 72 and a pressurized fluid 152 that are sealed within a frangible enclosure 154. The fluid production tracer material 72 may be a fluid (e.g., liquid and/or gas) or a solid (e.g., powdered material, particulate, solid body, etc.). The pressurized fluid 152 is a pressurized fluid tracer injector and may be liquid and/or a gas (e.g., nitrogen) that has been compressed to a predetermined value. The fluid production tracer material 72 may be mixed with or separated from the pressurized fluid 152. The enclosure 154 may be configured to fracture, crack, or otherwise break upon or after detonation of an adjacent shaped charge 60. The enclosure 154 may be configured to break due to the shock waves generated by the initiated shaped charge 60 or by a separate device (not shown). When broken, the pressurized fluid 152 escapes the enclosure 154 and injects the entrained fluid production tracer material 72 into an adjacent formation.

Figure 6B:
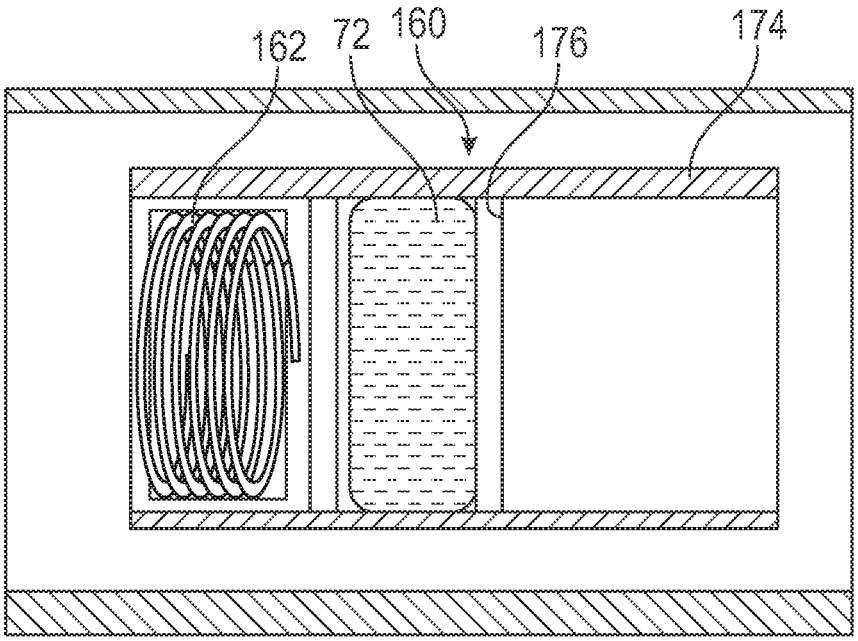

Referring to FIG. 6B, there is schematically illustrated yet another tracer package 160 in accordance with one embodiment of the present disclosure. The tracer package 160 may include a body of fluid production tracer material 72 and a compressed biasing member 162 that are sealed within an enclosure 174. The fluid production tracer material 72 may be a fluid (e.g., liquid and/or gas) or a powdered material. The compressed biasing member 162 is a mechanical tracer injector, which may be configured as a spring. The fluid production tracer material 72 is sealed within a suitable chamber 176 in the enclosure 174. The chamber 176 may be configured to fracture, crack, or otherwise break upon or after detonation of an adjacent shaped charge 60. The compressed biasing member 162 may be configured to expand due to the shock waves generated by the detonated shaped charge 60 or by a separate device (not shown). Due to the expansion, the fluid production tracer material 72 is injected into an adjacent formation.

Figure 7A:
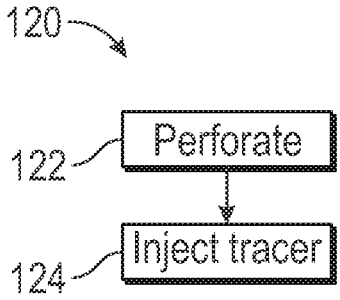
FIGS. 7A-B are flow charts depicting various methods for perforating and deploying tracers according to the present disclosure.
Figure 7B:
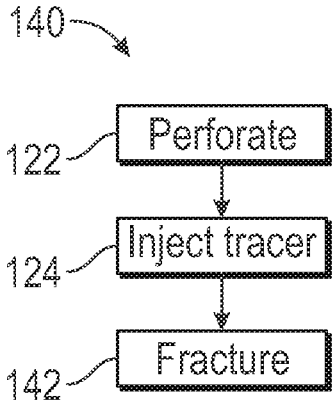

Referring to FIGS. 7A-B, there are illustrated flow charts for several non-limiting methods for perforating and adding fluid production tracers to a formation. In the FIG. 7A method 120, the tracer packages are configured such that the gas generator generates enough gas to transport the fluid production tracer but not enough to fracture a formation. Thus, the method 120 includes perforating the formation at step 122 and injecting the fluid production tracer material into the formation at step 124. In the FIG. 7B method 140, the tracer packages are configured such that the gas generator generates enough gas to transport the fluid production tracer material but not enough to fracture a formation. Thus, the method 140 includes perforating the formation at step 122 and injecting the fluid production tracer material into the formation at step 124. However, a subsequent fracturing operation, such as a fracturing operation using a liquid pumped from the surface, is performed at step 142. It should be noted a separate liquid hydraulic fracturing operation could also be performed in connection with the FIG. 7A method. Additionally, one or more fluid production tracers could be injected into the formation during those separate liquid hydraulic fracturing operations.

The teachings of the present disclosure may be used with oil soluble and/or water soluble chemical tracers. In embodiments where a water soluble chemical tracer is used, periodic sampling of produced water at the surface can provide information useful for evaluating subsurface conditions. For example, the cluster efficiency of a perf and plug hydraulic operation can be determined. Also, the water soluble chemical tracers may be formulated for specific applications such as steam assisted gravity draining (SAGD) wells to be understand the response of the reservoir to injected steam.

Generally, suitable fluid production tracers may include those commonly described in the art as dyes, pigments, and colorants. These compounds are often visible to the eye in either ambient or ultraviolet light. Suitable chemical tracers useful with the present disclosure include but are not limited to: Acridine Orange (CAS Registry No. 65-61-2); 2-anthracenesulfonic acid, sodium salt; Anthrasol Green IBA (CAS Registry No. 2538-84-3, aka Solubilized Vat Dye); and bathophenanthrolinedisulfonic acid disodium salt (CAS Registry No. 52746-49-3).

Other visible fluid production tracers useful with the present disclosure include fluoroscein (aka yellow/green dye) and rhodamine WTS (aka red dye). Other dyes which could be used with the present disclosure would be readily determined by a skilled chemist with routine experimentation by seeing which dyes have the desired organic solvent solubility and selective solubility in a particular application. Any such dye, pigment or colorant known to those skilled in the art of using visible fluid production tracers in oil well applications to be useful may be used with the present disclosure.

Non-visible fluid production tracers may also be used. The fluid production tracers useful with the present disclosure include any known to those ordinary skill in the art of using chemical tracers in oil and gas operations to be useful, but preferably are those which can be detected at concentrations low enough to make their use economically practical in such operations and low enough not to interfere with the carrier fluid or other materials present in the oil well. The useful fluid production tracers may also be able to interact with the measurement devices of the disclosure, in some applications.

Preferably the chemical tracers useful with the present disclosure include but are not limited to: fluorinated benzoic acids including 2-fluorobenzoic acid; 3-fluorobenzoic acid; and 4-fluorobenzoic acid.

Any chemical compound can be used as fluid production tracer material with the present disclosure if: it is not present at a measurable level in the reservoir fluids being produced from the well being tested, it can be measured at levels sufficiently low to allow its use to be economical, and the fluid production tracer, at the levels used, does not interfere or interact undesirably with other materials present in the oil well or interact undesirably with materials present in the formation surrounding a borehole (e.g., formation rock). Preferably, the fluid production tracers are detectable at a range of from about 1 parts per trillion to about 10,000 parts per million in the fluid being analyzed. Preferably the fluid production tracers are detectable at a range of from 5 parts per trillion to about 1,000 parts per million. More preferably the fluid production tracers are detectable at a range of from 100 parts per trillion to about 100 parts per million. At concentrations greater than about 1000 parts per million, the use of some fluid production tracers can become prohibitively expensive or cause unacceptable interactions with other materials present in an oil well.

Figure 8A:
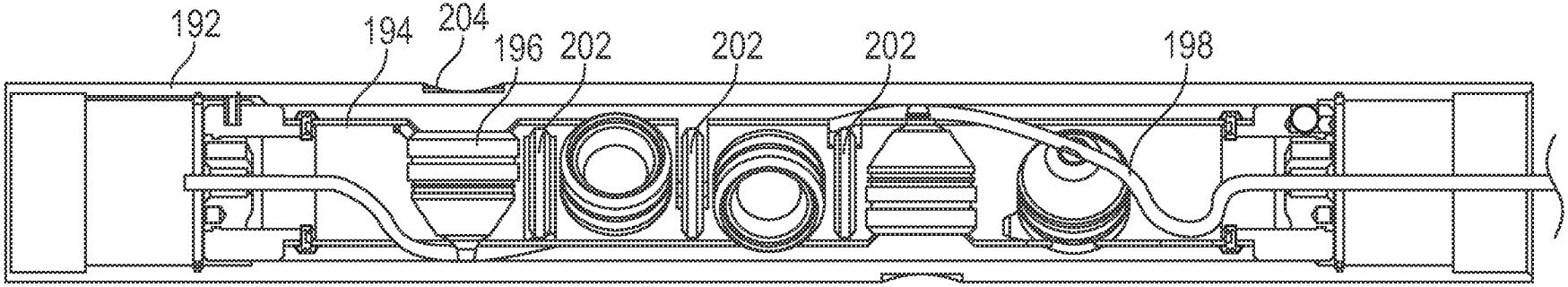
FIGS. 8A-B illustrate further embodiments of a perforating gun that uses tracer packages according to the present disclosure.

Referring to FIGS. 8A and B, there are shown two non-limiting embodiments of a perforating gun 190 according to the present disclosure. Each perforating gun 190 includes a carrier 192, a charge holder 194, a plurality of shaped charges 196 (one of which is labeled), and a detonator cord 198.

The FIG. 8A is similar to the FIG. 2 embodiment in that the tracer package is formed as a capsule 202 that combines one or more fluid production tracers and one or more gas generating materials. The capsules 202 are interposed between the shaped charges 196. Detonating of the shaped charges 196 breaks up the capsules 202 and initiates the gas generating material, e.g., propellant. The high pressure gases generated by the gas generating material conveys the released fluid production tracers into the formation via openings made by the shaped charges 196 in the carrier 192. Optionally, scallops 204, which are reduced wall thickness areas, may be formed at locations where the jets formed by the shaped charges 196 penetrate through the carrier 192.

Figure 8B:
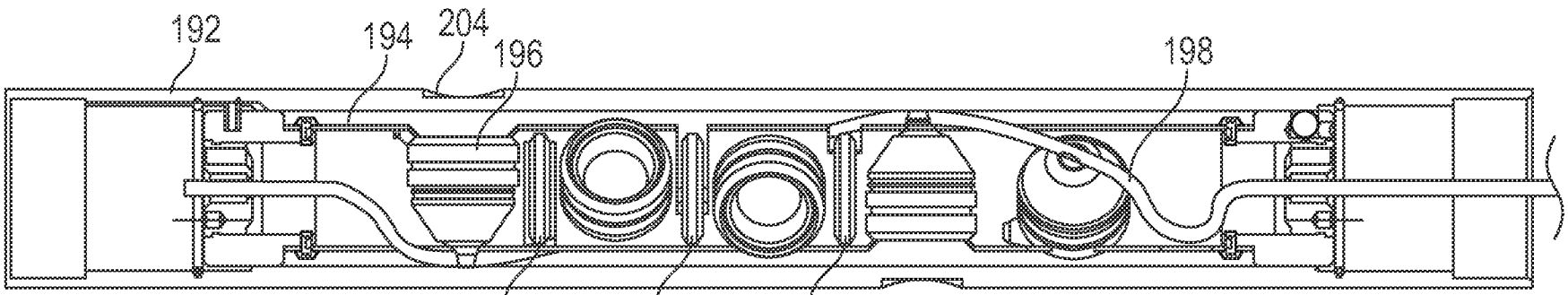

The FIG. 8B is similar to the FIG. 3 embodiment in that the tracer package is formed as capsules 206, 208. The capsule 206 includes one or more fluid production tracers and the capsules 208 include one or more propellant materials. The capsules 206, 208 are interposed between the shaped charges 196. Detonating of the shaped charges 196 breaks up the capsules 206, 208 and initiates the propellant material. The high pressure gases generated by the propellant material conveys the released fluid production tracers into the formation via openings made by the shaped charges 196 in the carrier 192. Optionally, scallops 204, which are reduced wall thickness areas, may be formed at locations where the jets formed by the shaped charges 196 penetrate through the carrier 192.

Figure 9:
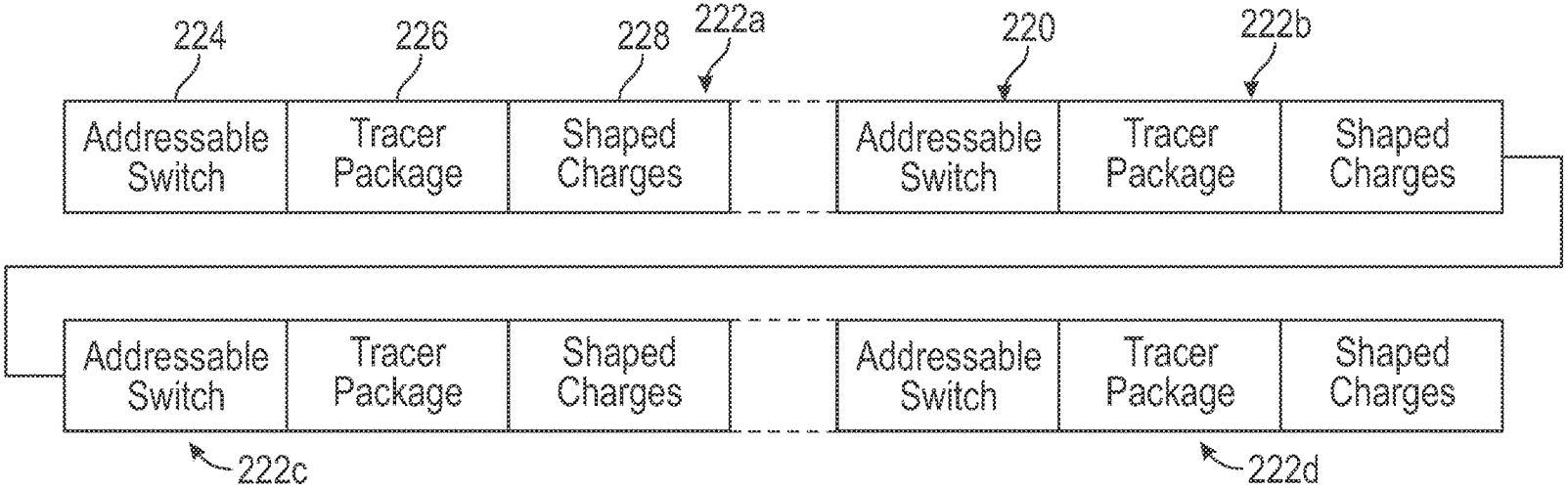
FIG. 9 illustrates in block diagram format a perforating tool that uses addressable switches according to one embodiment of the present disclosure.

Referring to FIG. 9, there is shown a perforating tool 220 according to another embodiment of the present disclosure. The perforating tool 220 includes two or more perforating guns 222*a-d*. Four guns are shown, but other quantities may be used. The guns 222*a-d* are similar in construction. Therefore, reference will be made only to gun 222*a* for clarity. The gun 222*a* may include an addressable switch 224, a tracer package 226, and one or more shaped charges 228. The addressable switch 224 may be programmed with a unique identifying code which allows a signal from the surface to address only a specific gun assembly, here gun 222*a*. Thus, each addressable switch 224 of guns 222*a-d* will have a different identifying code. The addressable switch 224 may be used to initiate the tracer package 226 and/or the shaped charges 228 of a particular gun, here gun 222*a*. The tracer package 226 may be any of the tracer packages discussed above. Also, as discussed above, the activation of the tracer package 226 may be connected to or independent of the detonation of the shaped charges 228. It should be appreciated that the use of addressable switches allows surface personnel to select which fluid production tracers are injected into the formation. For example, if the guns 222*a-d* each have different fluid production tracers, then the use of an addressable switch allows surface personnel to select a particular fluid production tracer material for a particular depth.

Figure 10:
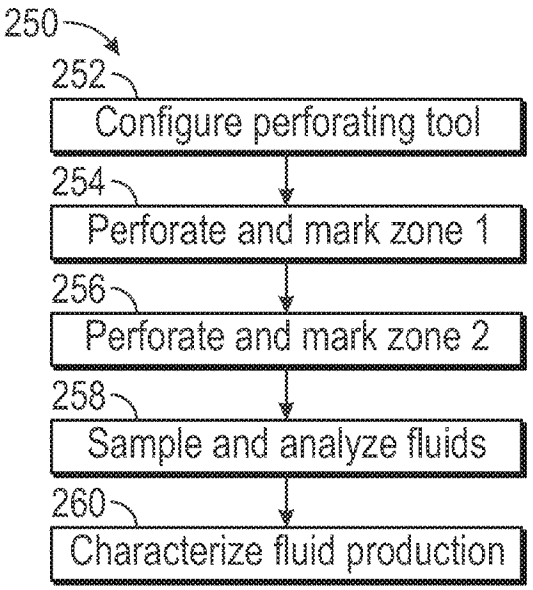
FIG. 10 illustrates further an embodiment of a method for injecting one or more formations with tracers.

Referring to FIG. 10, there is shown an embodiment of a method 250 for injecting fluid production tracers into one or more subsurface formations. For ease of discussion, reference will be made to the FIG. 9 perforating tool 200. At step 252, the perforating tool 200 may be configured to inject a different fluid production tracer into each of two or more production zones. At step 254, a first zone, or zone 1, is perforated and injected with a first fluid production tracer. At step 256, another zone, or zone 2, is perforated and injected with a second, different fluid production tracer. In embodiments, more than two zones may be injected with different and uniquely identifying tracers. At step 258, fluids produced from a well that intersects the zones may be sampled and analyzed for the presence of the fluid production tracers. At step 260, using known techniques, personnel can characterize the quantity and/or nature of the fluids being produced at each of the zones.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

The invention claimed is:

1. A method for completing a subterranean formation having a borehole and a production structure, comprising:

conveying a perforator assembly into a borehole drilled in the subterranean formation, wherein the perforator assembly includes at least one shaped charge and at least one tracer package, wherein the tracer package includes at least one fluid production tracer material and a tracer injector, wherein the tracer injector includes a gas generating material;

forming at least one tunnel in the production structure by detonating one or more shaped charges;

initiating the gas generating material using an activation energy released by the detonation of the shaped charges; and injecting the at least one fluid production tracer material into the formation using a high-pressure gas generated by the gas generating material, wherein the at least one production tracer material is configured to physically associate with at least one resident fluid in the subterranean formation.

2. The method of claim 1, wherein the gas generating material is a propellant material.

3. The method of claim 2, wherein the at least one fluid production tracer material is dispersed in the propellant material.

4. The method of claim 2, wherein all of the at least one fluid production tracer material is physically separate from the propellant.

5. The method of claim 1, wherein the at least one fluid production tracer material is a solid.

6. The method of claim 1, wherein the at least one fluid production tracer material is a fluid.

7. The method of claim 6, wherein the at least one fluid production tracer material is enclosed in separate enclosure from the tracer injector.

8. The method of claim 7, wherein the at least one fluid production tracer material is one of: (i) a liquid, and (ii) a gas.

9. An apparatus for marking a selected location in a subterranean formation, comprising:

a least one shaped charge configured to generate a perforating jet, wherein detonation of the at least one shaped charge releases thermal energy and shock waves; and a tracer package including:

at least one fluid production tracer; and a tracer injector positioned adjacent to the at least one shaped charge, the tracer injector configured to inject the at least one fluid production tracer material into the subterranean formation, wherein the tracer injector includes a gas generating material configured to be initiated by an activation energy released by the detonation of the at least one shaped charge, wherein a high-pressure gas generated by the gas generating material is selected to inject the at least one fluid production tracer material into the subterranean formation.

10. The apparatus of claim 9, wherein the gas generating material is a propellant material.

11. The apparatus of claim 10, wherein the at least one fluid production tracer material is dispersed in the propellant material.

12. The apparatus of claim 10, wherein all of the at least one fluid production tracer material is physically separate from the propellant.

* * * * *